US007373930B1

(12) United States Patent
Hadre

(10) Patent No.: US 7,373,930 B1
(45) Date of Patent: May 20, 2008

(54) MULTI-PORT CHECK-VALVE FOR AN EVAPORATIVE FUEL EMISSIONS SYSTEM IN A TURBOCHARGED VEHICLE

(75) Inventor: Christopher Hadre, LaSalle (CA)

(73) Assignee: Chrysler LLC, Auburn Hills, MI (US)

( * ) Notice: Subject to any disclaimer, the term of this patent is extended or adjusted under 35 U.S.C. 154(b) by 0 days.

(21) Appl. No.: 11/843,992

(22) Filed: Aug. 23, 2007

(51) Int. Cl.
*F02M 33/02* (2006.01)

(52) U.S. Cl. ..... 123/520; 123/198 D

(58) Field of Classification Search ..... 123/520, 123/519, 516, 518, 382, 383, 198 D
See application file for complete search history.

(56) References Cited

U.S. PATENT DOCUMENTS 4,530,210 A * 7/1985 Yamazaki ..... 60/605.1
4,646,702 A * 3/1987 Matsubara et al. ..... 123/520
5,005,550 A * 4/1991 Bugin et al. ..... 123/520
5,183,023 A * 2/1993 Hanson ..... 123/520
5,235,955 A 8/1993 Osaki
5,245,974 A * 9/1993 Watson et al. ..... 123/518
5,533,479 A * 7/1996 Wild et al. ..... 123/520
5,690,086 A * 11/1997 Kawano et al. ..... 123/674
5,698,780 A * 12/1997 Mizutani et al. ..... 73/118.2

* cited by examiner

*Primary Examiner*—Carl S. Miller
(74) *Attorney, Agent, or Firm*—Alexander Zelikov

(57) ABSTRACT

A multi-port check-valve for a fuel vapor emissions system coupled to an intake manifold of an internal combustion engine with forced induction and of the type including a purge canister and a purge valve, comprising a first port coupled to the purge valve, a second port in fluid communication with the first port and having a first check-valve with a fixed orifice arranged to open in response to engine vacuum, and bleed intake manifold boost pressure.

6 Claims, 7 Drawing Sheets

MULTI-PORT CHECK-VALVE FOR AN EVAPORATIVE FUEL EMISSIONS SYSTEM IN A TURBOCHARGED VEHICLE

FIELD OF THE INVENTION

The present invention relates to an evaporative fuel emissions control system for an internal combustion engine, and, more particularly, to a check valve for an evaporative fuel emissions control system for an internal combustion engine of the type that includes forced induction.

BACKGROUND OF THE INVENTION

Modern internal combustion engines generate approximately 20% of all of their hydrocarbon emissions by evaporative means, and as a result, automobile fuel vapor emissions to the atmosphere are tightly regulated. For the purpose of preventing fuel vapor from escaping to the atmosphere an Evaporative Emissions Control (EVAP) system is typically implemented to store and subsequently dispose of fuel vapor emissions. The EVAP system is designed to collect vapors produced inside an engine's fuel system and then send them through an engine's intake manifold into its combustion chamber to get burned up as part of the aggregate fuel-air charge. When pressure inside a vehicle's fuel tank reaches a predetermined level as a result of evaporation, the EVAP system transfers the vapors to a charcoal, or purge canister. Subsequently, when engine operating conditions are conductive, a purge valve opens and vacuum from the intake manifold draws the vapor to the engine's combustion chamber. Thereafter, the purge canister is regenerated with newly formed fuel vapor, and the cycle continues.

As opposed to vacuum in naturally aspirated applications, at higher throttle levels a turbocharged/supercharged engine's intake manifold can see relatively high boost pressures generated by forced induction. A purge valve, which is not designed to withstand high boost pressures, can sometimes be damaged under such conditions. Damage to the purge valve, in tun, is sufficient to incapacitate an EVAP system. Typically, a simple check-valve is employed in a purge harness of an engine with forced induction to prevent high boost pressures from impacting the purge valve.

In addition to fuel vapor recovery function, an EVAP system is required to perform a leak-detection function. To that end, a known analog leak-detection scheme employs an evaporative system integrity monitor (ESIM) switch which stays on if the system is properly sealed, and toggles off when a system leak is detected. When the ESIM switch is toggled off, an engine control unit (ECU) detects the change and alters an operator of the vehicle with a malfunction indicator.

Furthermore, an EVAP system's ability to detect leaks must be regularly verified in engine key-off mode via a so-called rationality test. The rationality test confirms the ESIM switch functionality through a simulated system leak which is generated by opening the purge valve to relieve a low level of system vacuum (approximately 0.5 KPa) retained from when the engine was running. An ECU then looks for the ESIM switch to toggle from on to off, which is an indicator that the switch is functioning correctly. For the rationality test to be performed in a forced induction engine, however, a leak-detection scheme utilizing an ESIM switch requires a two-way low airflow communication between the purge valve and the intake manifold. A simple check-valve does not permit two-way flow, therefor it will not support both purge valve over-pressure protection and ESIM functions in an EVAP system of a forced induction engine.

In view of the above, an effective apparatus is needed for permitting an EVAP system to accomplish its prescribed fuel evaporative emissions purge and leak detection functions in forced induction applications, while also protecting the system components from damage that can result from high boost pressures.

SUMMARY OF THE INVENTION

The present invention is a multi-port check-valve for a fuel vapor emissions system coupled to an intake manifold of an internal combustion engine with forced induction and of the type including a purge canister and a purge valve. According to the invention, the multi-port check-valve has a first port coupled to the purge valve, and a second port in fluid communication with the first port. The second port has a first check-valve with a fixed orifice, wherein the check-valve is positioned to open in response to engine vacuum, and the fixed orifice is arranged to bleed intake manifold boost pressure. Additionally, the multi-port check-valve has a third port in fluid communication with the first and second ports, which includes a second check-valve arranged to release the boost pressure to atmosphere or to the engine's air box.

An alternative embodiment of the present invention is a method for preventing high intake manifold boost pressure from directly impacting, and possibly damaging, the purge valve in a purge harness of a fuel vapor emissions system of an internal combustion engine with forced induction. The method includes a step of providing a first check-valve having a fixed orifice whereby, in one instance the first check-valve opens in response to engine vacuum drawn by the intake manifold, and in another instance bleeds boost pressure received from the intake manifold. The method further includes providing a second check-valve in fluid communication with said first check-valve to release the boost pressure to atmosphere or to the engine's air box.

The foregoing apparatus and method are suitable for use in a turbocharged engine.

The detailed description and specific examples which follows, while indicating preferred embodiments of the invention, are intended for purposes of illustration only and are not intended to limit the scope of the invention.

DETAILED DESCRIPTION

The present invention is directed to a multi-port check-valve for use in a purge harness of an EVAP system for an internal combustion engine with forced induction. The multi-port check-valve being an apparatus for permitting the EVAP system to accomplish its prescribed fuel evaporative emissions purge and leak detection functions in forced induction applications, while being configured to avoid damage that can result from high boost pressures. Typically, a purge valve is unable to reliably withstand boost pressure generated by forced induction, which in a modern engine can often exceed 15 psi (103 KPa).

Figure 1:
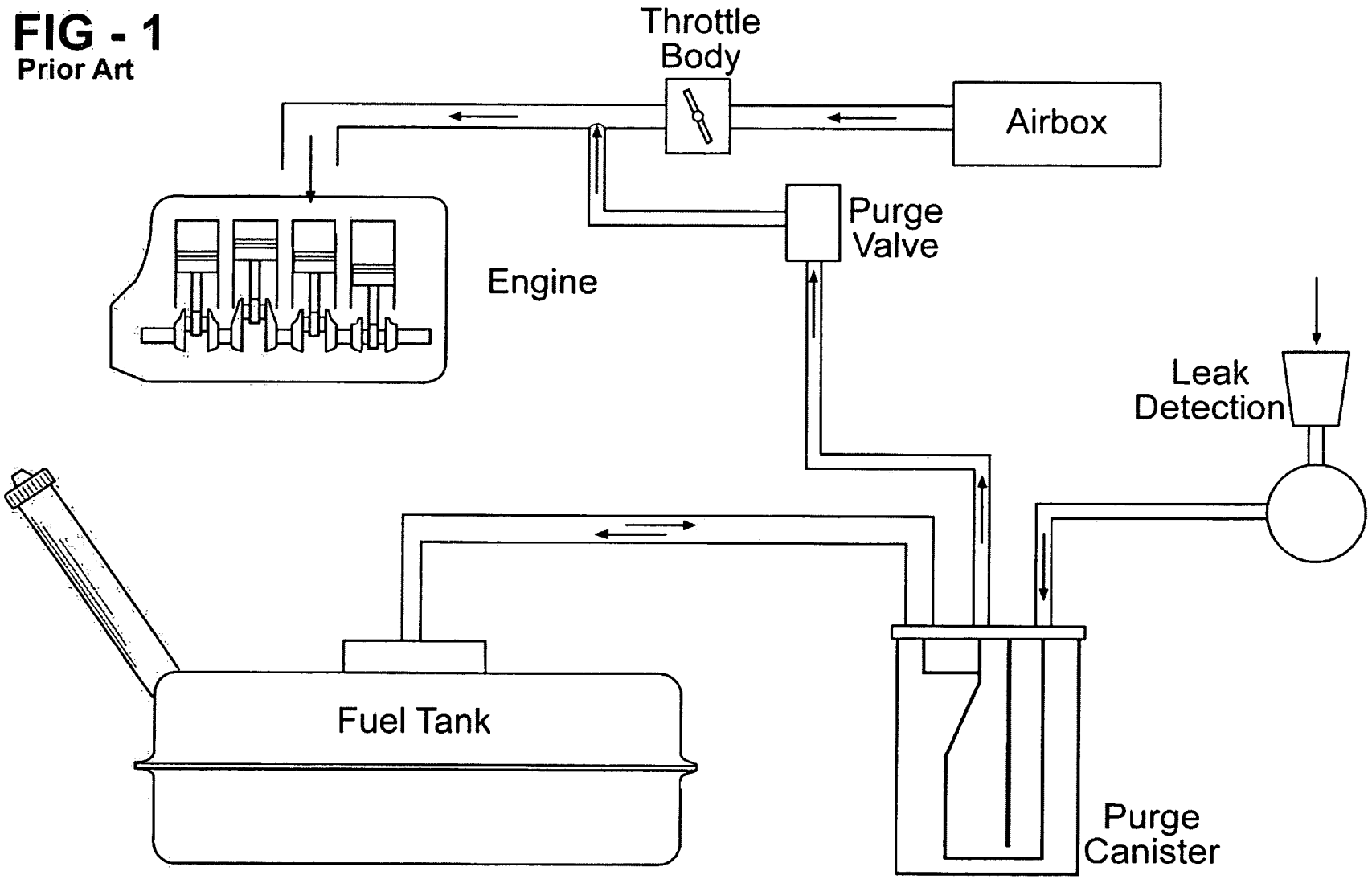
FIG - 1 Prior Art
FIG. 1 is a schematic diagram of an EVAP system of a typical internal combustion engine.
Figure 2:
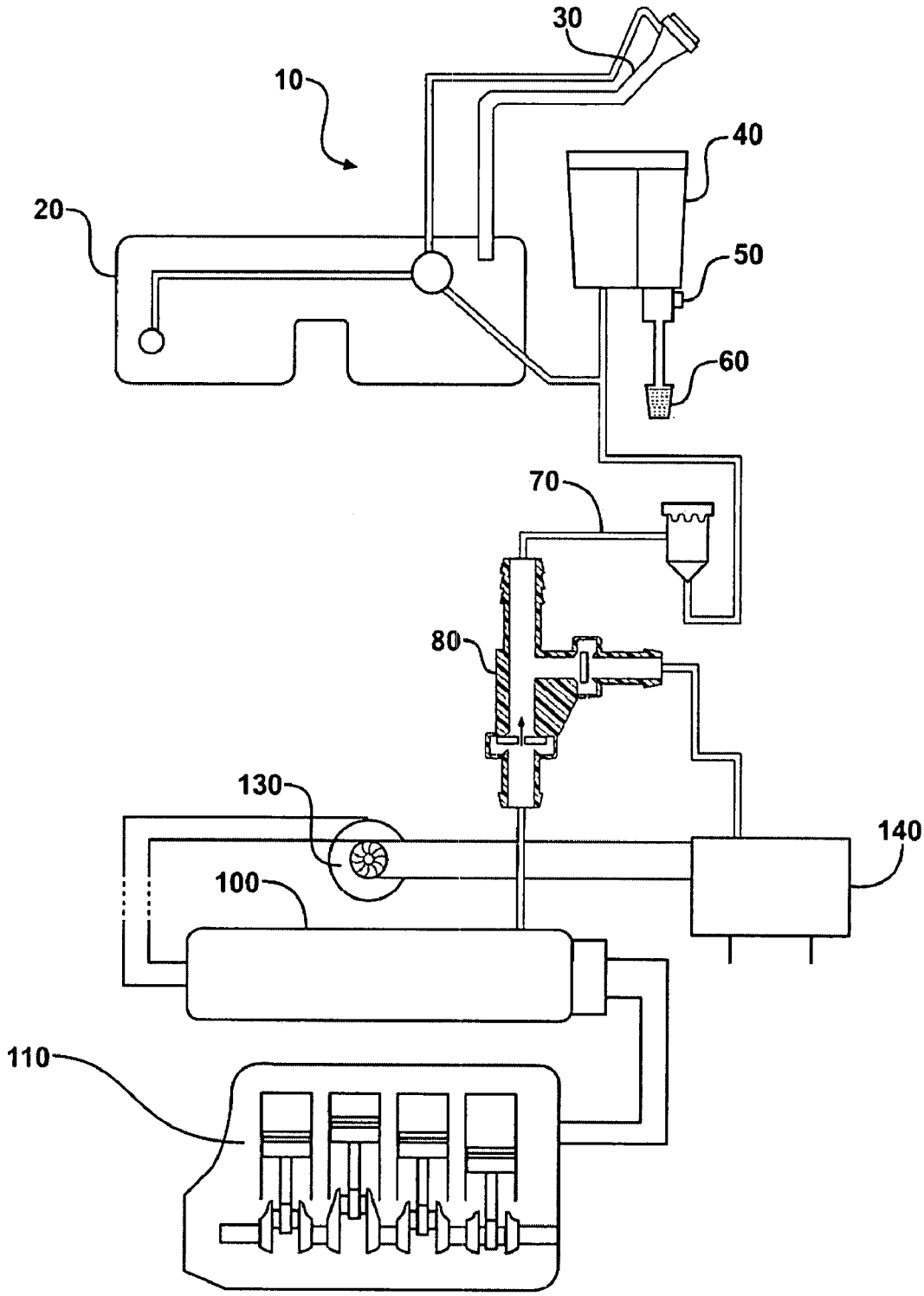
FIG. 2 is a schematic diagram of an EVAP system of a turbocharged internal combustion engine according to the invention.
Figure 3:
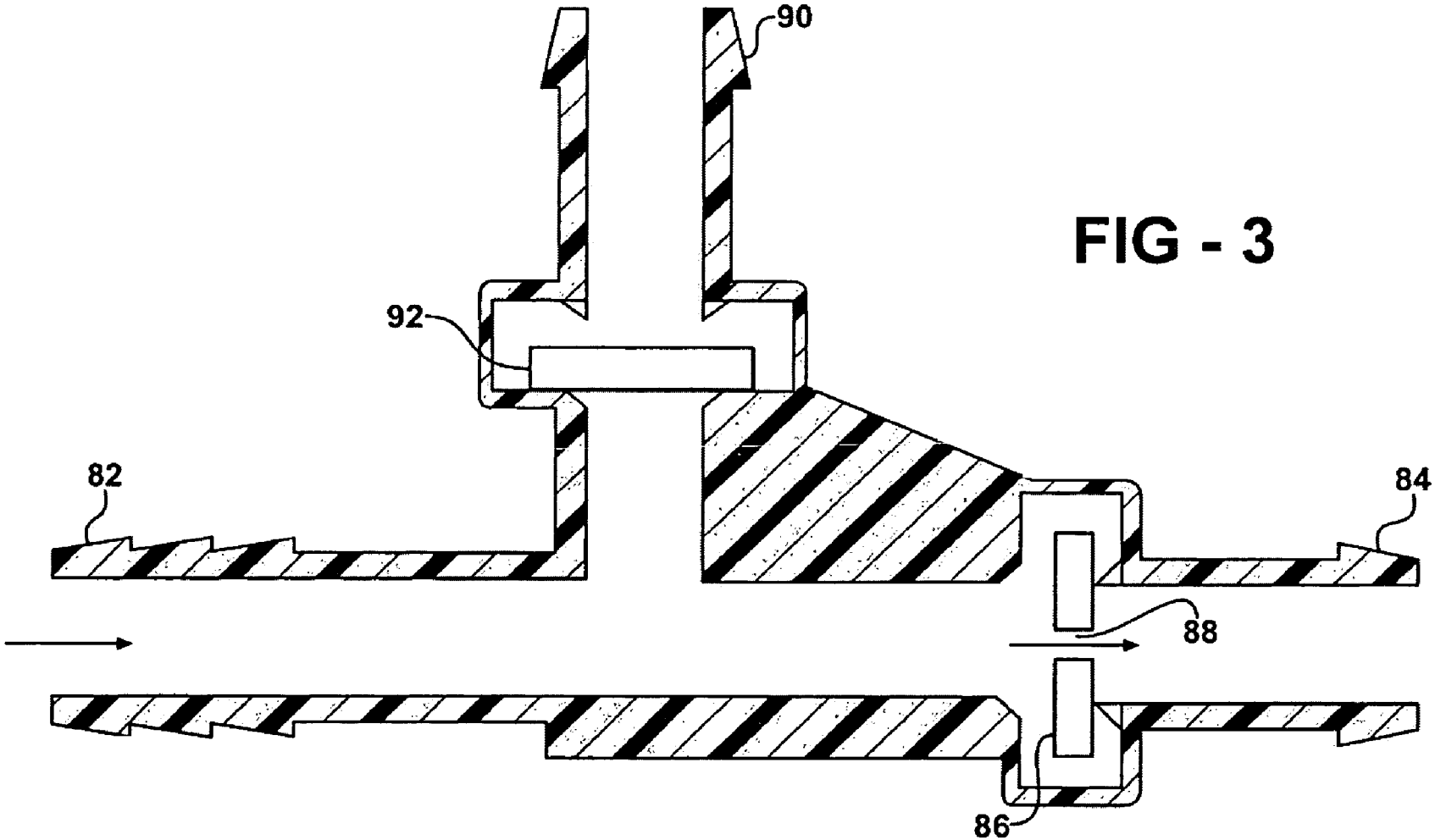
FIG. 3 is a cross sectional view of the multi-port check-valve in engine vacuum mode according to the invention.

Referring now to the drawings in which like elements of the invention are identified with identical reference numerals throughout, FIG. 1 denotes an EVAP system schematic diagram of a typical internal combustion engine. EVAP system 10 of a forced induction internal combustion engine is best seen from FIG. 2. EVAP system 10 includes a fuel tank 20, and a fill tube 30 in fluid communication with the fuel tank. Purge canister 40 is in fluid communication with fuel tank 20 for capturing fuel vapor from the fuel tank. Purge canister 40 is additionally in fluid communication with purge valve 70, which releases the purge canister's fuel vapor contents to multi-port check-valve 80 in response to engine manifold vacuum. Multi-port check-valve 80 is made from a material that is resistant to a hydrocarbon environment, but is preferably made from an engineering plastic for economic reasons. Purge canister 40 is in fluid communication with ESIM switch 50, which is configured to stay on if the EVAP system is operatively sealed in the presence of engine vacuum, and to toggle off if the EVAP system experiences a leak (loss of vacuum). ESIM switch 50 is in fluid communication with atmosphere via filter 60.

Figure 4:
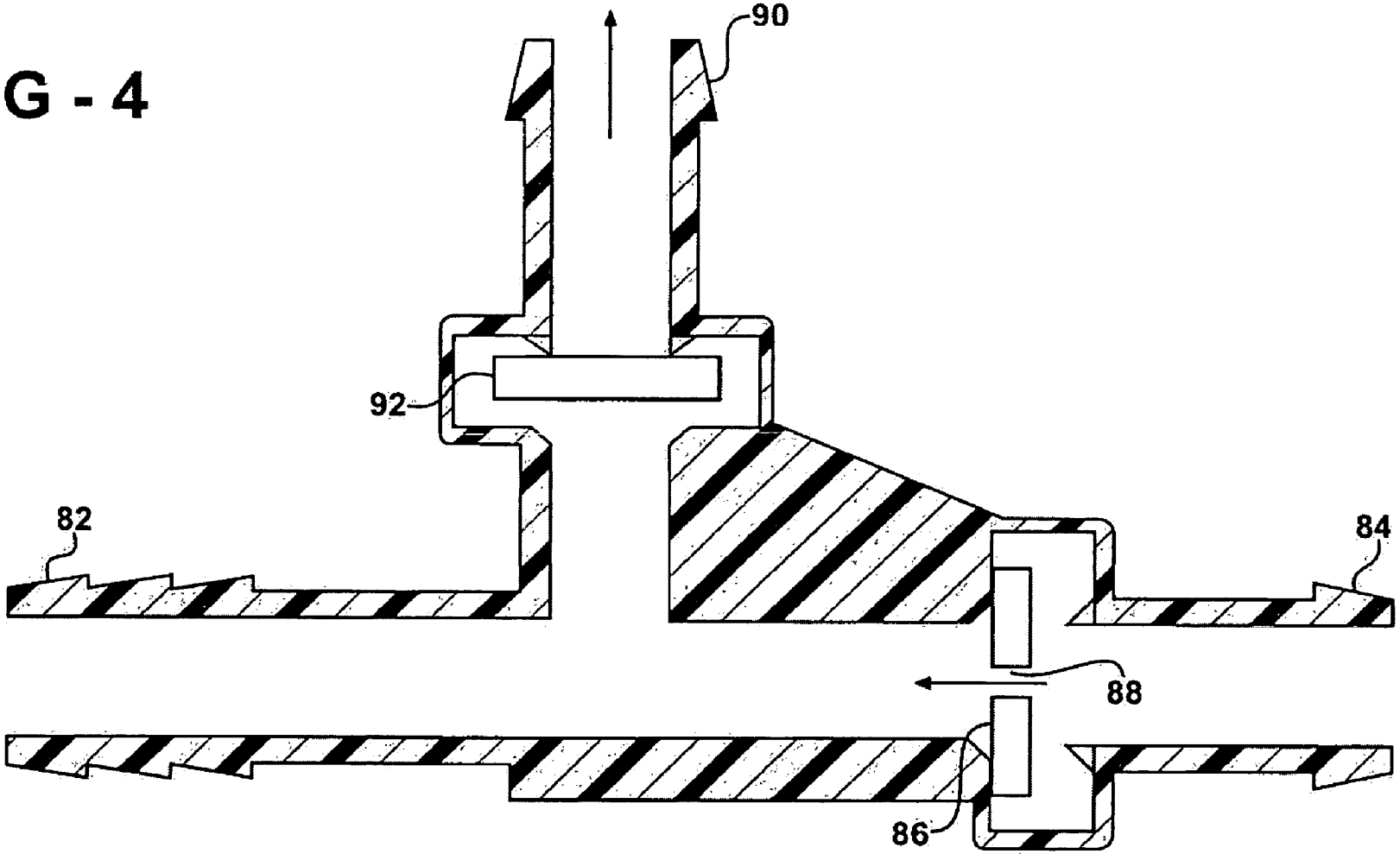
FIG. 4 is a cross sectional view of the multi-port check-valve in engine boost mode according to the invention.
Figure 5:
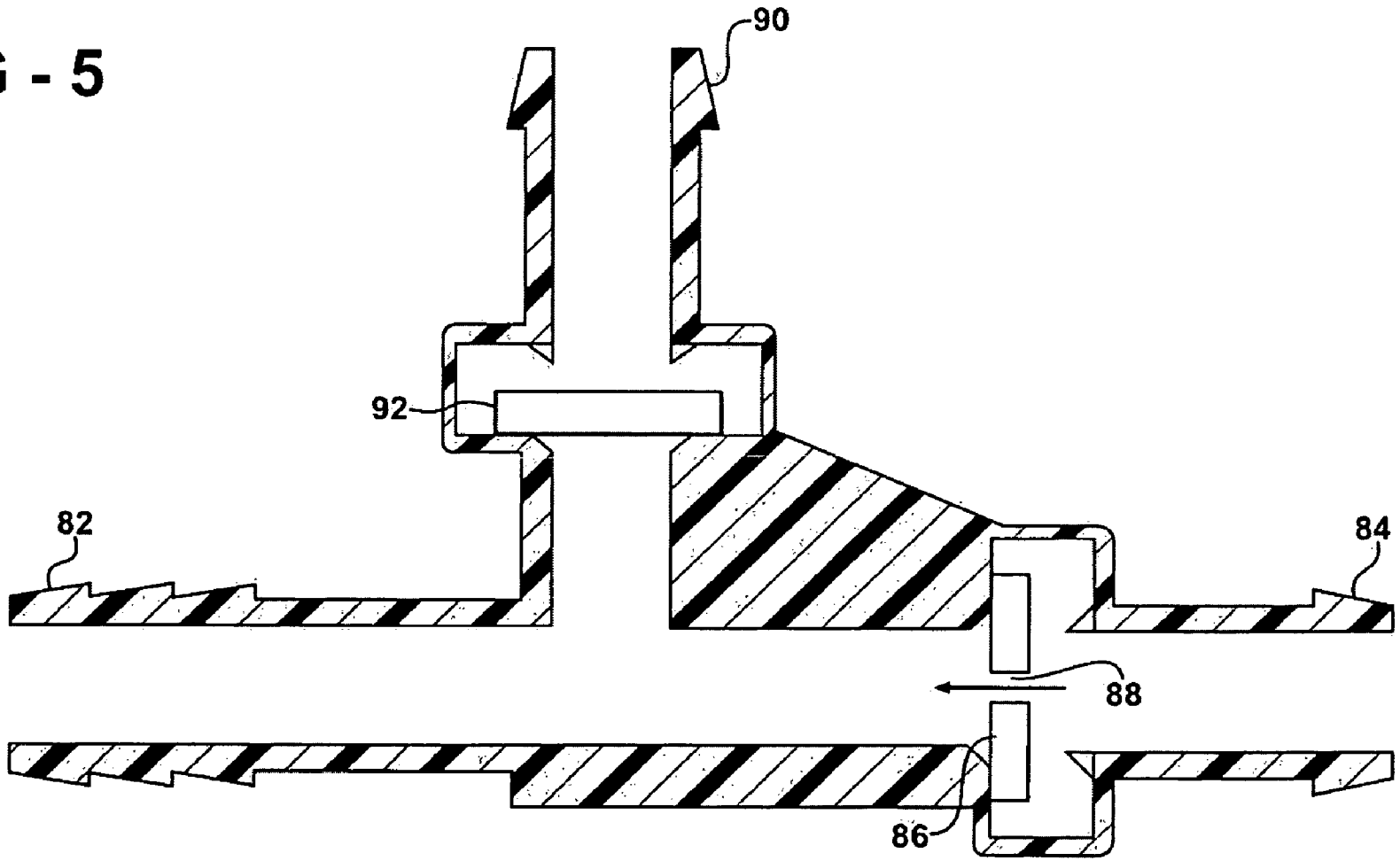
FIG. 5 is a cross sectional view of the multi-port check-valve in ESIM leak-detection mode according to the invention.

Multi-port check-valve 80 is best seen from FIGS. 3-6, which denote the multi-port check-valve in its three modes of operation, the engine vacuum mode, the engine boost mode, and the ESIM leak-detection mode. Multi-port check-valve 80 comprises port 82 in fluid communication with purge valve 70, and port 84 in fluid communication with port 82 and with intake manifold 100. Intake manifold 100 communicates vacuum generated by an engine's reciprocating pistons 110, or boost pressure supplied by exhaust-driven turbocharger 130, a crankshaft-driven supercharger (not shown), or any other pressurizing means. Port 84 includes check-valve 86 which is arranged to open in response to engine vacuum during the vacuum mode (FIG. 3), and direct fuel vapor drawn by engine vacuum from purge canister 40. The drawn fuel vapor is transferred via intake manifold 100 to engine's combustion chamber (not shown) to be burned with the main fuel-air charge. Port 84 additionally includes fixed orifice 88 which is arranged to bleed intake manifold boost pressure when the engine is operating in boost mode (FIG. 4). Fixed orifice 88 has a diameter which is empirically determined by balancing the competing requirements of permitting maximum pressure that purge valve 70 is able to reliably withstand, and bleeding fuel tank vacuum in under 30 seconds. Under boost, when purge valve 70 is closed, direction of flow is reversed, and the engine's compressed air charge is directed back to port 84 via intake manifold 100. Check-valve 86 closes in response to the compressed air charge passing from the intake manifold, while fixed orifice 88 effectively manages manifold boost pressure by bleeding the compressed air charge. Multi-port check-valve 80 also includes port 90 in fluid communication with ports 82 and 84. Check-valve 92 is positioned within port 90 and is arranged to release bled compressed air charge to atmosphere, or to engine air box 140 which is arranged to deliver ambient air charge to the engine. The foregoing boost-bleed function of fixed orifice 88 and check-valve 92 thereby protect purge valve 70 from being damaged in cases of high intake manifold boost pressures.

In engine key-off mode, when air inside intake manifold 100 is at barometric pressure, the EVAP system is required to perform an ESIM leak-detection rationality test. In ESIM leak-detection mode (FIG. 5), purge valve 70 opens, and, in response to the EVAP system low level vacuum fixed orifice 88 dispenses intake manifold air to ESIM switch 50. The ECU then looks for the ESIM switch to toggle from on to off, thereby indicating that it is functioning properly. If ESIM switch 50 does not toggle to off, the ECU will set a malfunction indicator.

Figure 6:
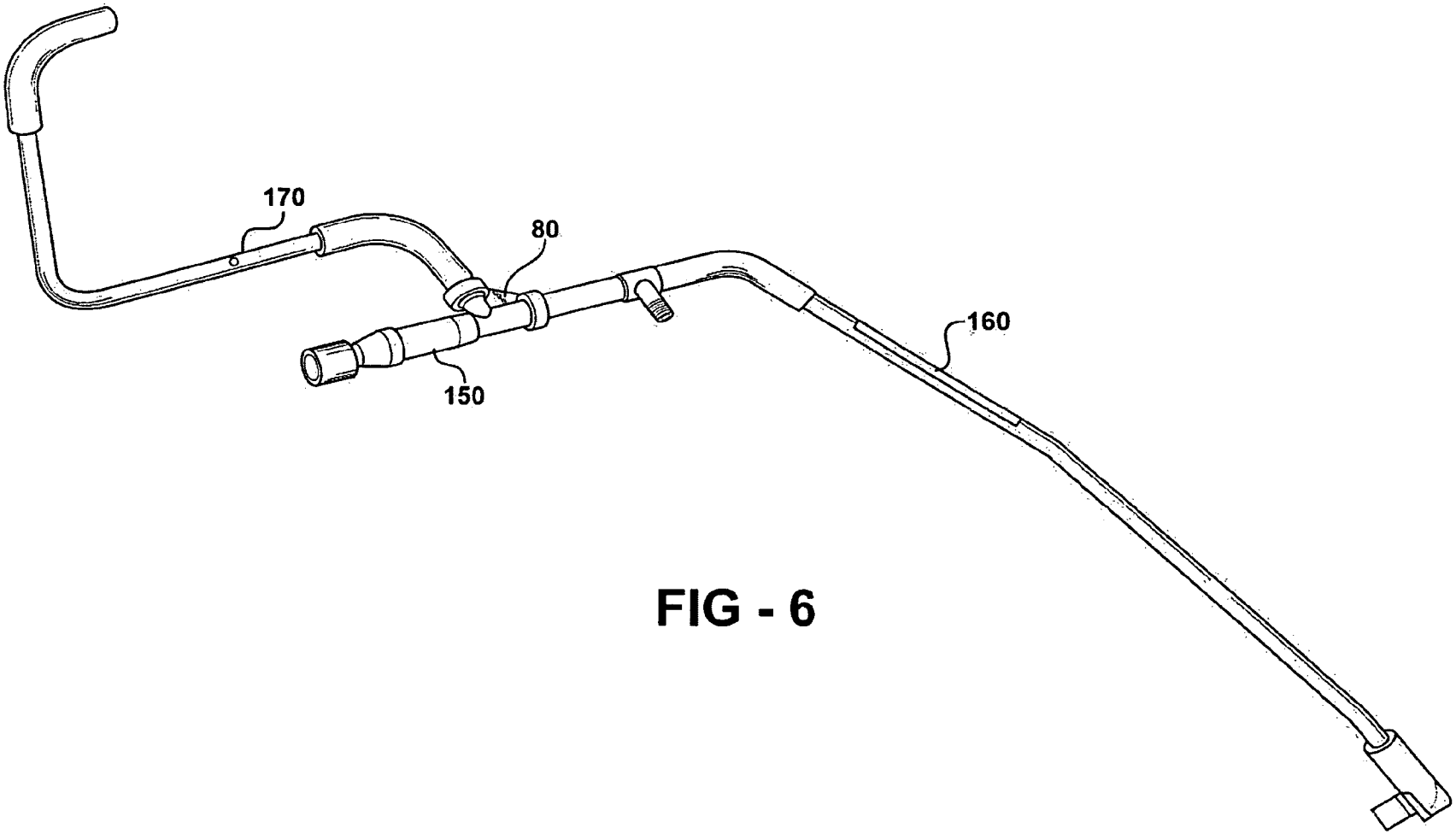
FIG. 6 is a perspective view of an EVAP system purge harness according to the invention.
Figure 7:
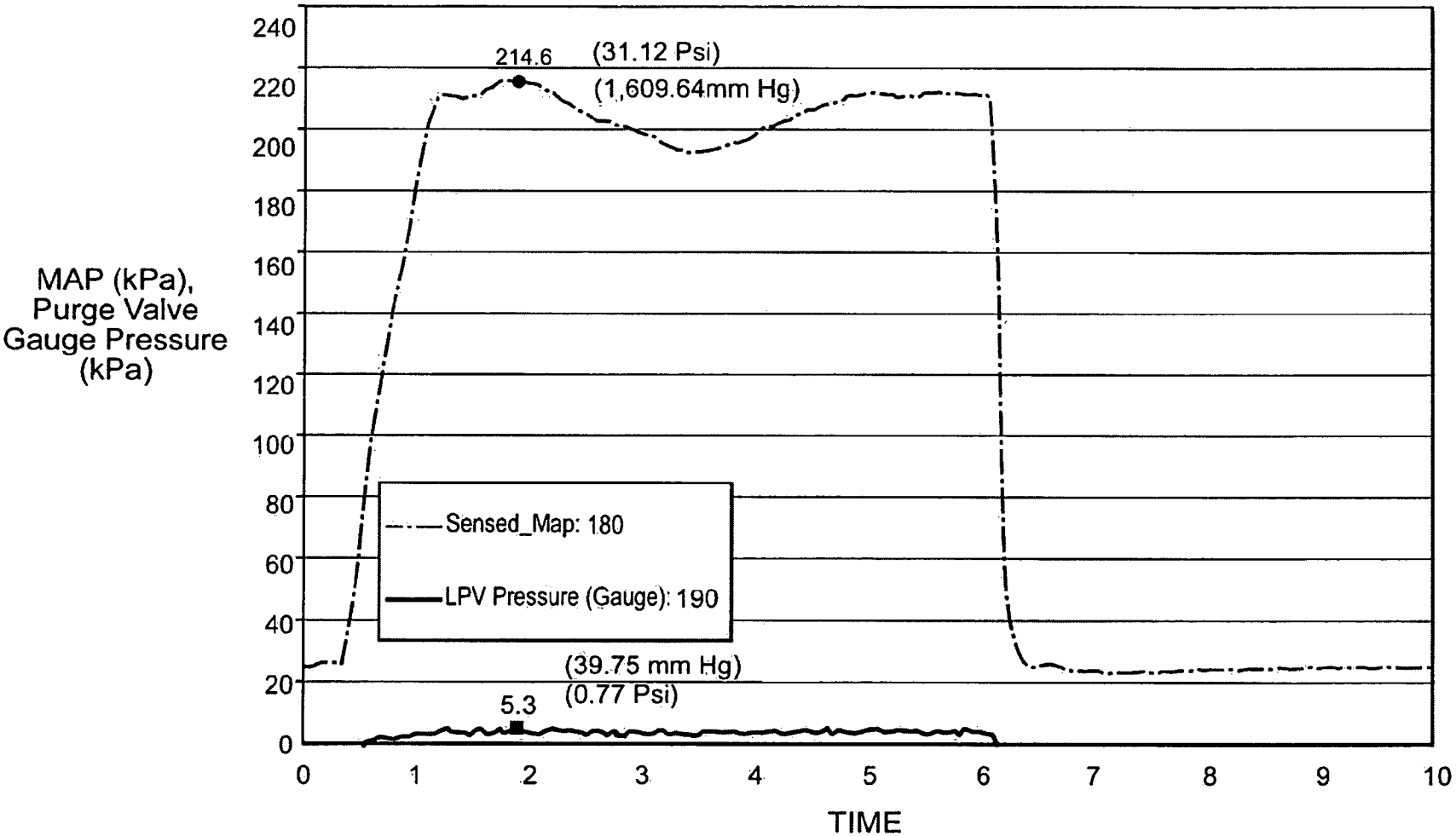
FIG. 7 is a view of a fixed orifice boost-bleed pressure graph according to the invention.

As best seen from FIG. 6, ports 82, 84, and 90 of multi-port check-valve 80 are connected to purge valve 70, intake manifold 100, and air box 140 via tubes 150, 160, and 170 respectively. Tubes 150, 160, and 170 are preferably made from an engineering plastic for economic reasons, but can also be made from a variety of other suitable materials, such as stainless steel.

FIG. 8 denotes fixed orifice 88 boost-bleed pressure graph, wherein sensed intake manifold absolute pressure (MAP) 180 and purge valve pressure 190 are plotted against time. The plot shows a factor of 40 reduction in pressure reaching purge valve 70 resulting from operation of fixed orifice 88, as compared with peak boost pressure in intake manifold 100. Thus, a multi-port check-valve of a design according to the invention can effectively function and protect an EVAP system purge valve in an operating environment susceptible to high manifold boost pressures.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A multi-port check-valve for a fuel vapor emissions system coupled to an intake manifold of an internal combustion engine with forced induction and of the type including a purge canister and a purge valve, comprising:

(a) a first port coupled to the purge valve;

(b) a second port in fluid communication with the first port and having a first check-valve with a fixed orifice arranged to open in response to engine vacuum, and, during a boost mode, bleed intake manifold boost pressure; and (c) a third port in fluid communication with the first and second ports and having a second check-valve arranged to release said boost pressure to atmosphere.

2. The apparatus of claim 1 wherein the second check-valve bleeds the intake manifold boost pressure to an engine's air box.

3. The apparatus of claim 1 wherein said internal combustion engine is turbocharged.

4. In a purge harness of a fuel vapor emissions system of an internal combustion engine with forced induction and of the type including a purge canister and a purge valve, a method for preventing intake manifold boost pressure from reaching the purge valve, comprising:

providing a first check-valve having a fixed orifice, wherein the first check-valve opens in response to engine vacuum drawn by the intake manifold, and the fixed orifice, during a boost mode, bleeds boost pressure received from the intake manifold; and providing a second check-valve in fluid communication with said first check-valve to release said boost pressure to atmosphere.

5. The method of claim 4 wherein the second check-valve bleeds the intake manifold boost pressure to an engine's air box.

6. The method of claim 4 wherein said engine is turbocharged.

* * * * *